US006358891B1

(12) United States Patent
Andersen

(10) Patent No.: US 6,358,891 B1
(45) Date of Patent: Mar. 19, 2002

(54) LUBRICATING/SEALING OIL-BASED COMPOSITION AND METHOD OF MANUFACTURE THEREOF

(76) Inventor: Leonard M. Andersen, P.O. Box 1529, New York, NY (US) 10116

( * ) Notice: Subject to any disclaimer, the term of this patent is extended or adjusted under 35 U.S.C. 154(b) by 0 days.

(21) Appl. No.: 09/620,738

(22) Filed: Jul. 20, 2000

Related U.S. Application Data

(60) Provisional application No. 60/145,031, filed on Jul. 22, 1999.

(51) Int. Cl.[7] ..... C10M 125/00

(52) U.S. Cl. ..... 508/151; 508/167; 508/181; 508/182

(58) Field of Search ..... 508/181, 182, 508/167, 150, 151

(56) References Cited

U.S. PATENT DOCUMENTS 4,224,173 A * 9/1980 Reick ..... 508/181
4,715,972 A * 12/1987 Pacholke ..... 508/181
5,520,830 A * 5/1996 Klaus et al. ..... 508/150
5,565,417 A * 10/1996 Salvia ..... 508/167
5,641,731 A * 6/1997 Baumgart et al. ..... 508/183
5,763,369 A * 6/1998 Baumgart et al. ..... 508/183
5,906,969 A 5/1999 Fyfe ..... 508/364
5,962,377 A * 10/1999 Baumgart et al. ..... 508/168
5,962,381 A 10/1999 Bovington ..... 508/501
5,965,495 A 10/1999 Goto et al. ..... 508/192
6,034,038 A * 3/2000 Lockwood et al. ..... 508/183
6,053,143 A 4/2000 Taylor ..... 123/196 AB
6,060,437 A 5/2000 Robson et al. ..... 508/371

* cited by examiner

*Primary Examiner*—Ellen M. McAvoy
(74) *Attorney, Agent, or Firm*—Darby & Darby

(57) ABSTRACT

A lubricating/sealing composition is provided according to the present invention and finds particular use as a lubricating medium in internal combustion engines. According to the present invention, the lubricating/sealing composition comprises a base lubricating oil; a plurality of polytetrafluoroethylene particles; a plurality of metal particles; a plurality of molybdenum disulfide particles; an emulsifying agent and a predetermined volume of water. These ingredients are subjected to an elevated temperature, elevated pressure, agitation and shear conditions to produce the composition of the present invention. The composition of the present invention serves not only to provide lubricating properties but also serves as a sealant which seals any areas of the engine which are prone to leaks and the like.

28 Claims, 1 Drawing Sheet

LUBRICATING/SEALING OIL-BASED COMPOSITION AND METHOD OF MANUFACTURE THEREOF

This application claims benefit of provisional application 60/145,031, filed Jul. 22, 1999.

FIELD OF THE INVENTION

This invention relates generally to lubricating compositions and more particularly relates to a composition for lubricating an internal combustion engine and sealing any leaks which may be present in one or more chambers of the engine, thereby causing a reduction in oil consumption and providing more efficient engine operation.

BACKGROUND OF THE INVENTION

Fuel economy and engine efficiency have attracted the attention of many scientists and engineers. Over the years, it has become more desirable to increase fuel efficiency in vehicles and other devices and also to reduce the emissions thereof. This has occurred as a result of a number of factors including the escalating cost of natural resources and the potential health concerns due to increased environmental pollution, including air, land, and water, which in part is due to an increase in fuel consumption by vehicles and other devices being driven by internal combustion engines. This increased awareness is evidenced by newly enacted government legislation and regulations governing vehicle emissions and preservation of the environment.

Often engine wear in various locations, such as cylinder rings, valve stems, and bearings, is responsible for excessive oil consumption. This results in diminished engine performance and also can result in engine oil leaks which likewise results in excessive oil consumption, increased operating costs, and is a direct source of pollution. Furthermore, engine wear and inefficient engine operation will result in increased emissions which causes an increase in air pollution. In general, the diminished engine performance is a result of a number of factors, including but not limited to:

(1) combustion gases passing through the rings of the piston instead of the gas being used to generate mechanical energy within the engine, etc.;

(2) lubricating oil entering the combustion chamber and interfering with the fuel air combustion process which results in an increase in pollution; and (3) the presence of worn engine bearings which facilitates oil consumption by diminishing the effectiveness of the engine seals. The wearing of the engine bearings diminishes engine performance because a loss of mechanical efficiency is realized due to the presence of excess gaps in the bearing assembly such that energy goes into vibration, etc., instead of being used to power the engine.

Thus, there is a perceived need to provide a lubricating oil which will not only provide desirable lubricating characteristics but will also provide increased engine performance in engines which are marked by engine wear.

SUMMARY OF THE INVENTION

According to the present invention, a lubricating/sealing composition is provided for use in internal combustion engines and the like. Advantageously, the present lubricating/sealing composition is designed to not only to lubricate engine components but also to provide a seal at locations in the engine where lubricating oil is seeping into the combustion chamber or leaking out of the engine itself. For example, such locations include but are not limited to annular spaces located around the pistons, valves, and the seals at the ends of the crank-shaft, etc. The continued wear and tear in the internal combustion engine will cause bearings, rings, valves and seals to wear such that lubricating oil seeps into the combustion chamber and renders mechanical inefficiency. In addition, leakage of lubricating oil can occur as a result of a number of other events. For example, leakage at the head gasket location often occurs as a result of engine over-heating and this can cause compression loss as well as the loss of lubricating oil.

By sealing these leak-prone locations in the engine, an improvement in the fuel efficiency of the internal combustion engine is realized. Accordingly, the lubricating/sealing composition of the present invention improves wear of the rings, bearings, valves and seals and also renders increased engine performance by providing a substance which not only lubricates but also serves to seal areas in the engine which are prone to fluid leaks.

DETAILED DESCRIPTION

Figure 1:
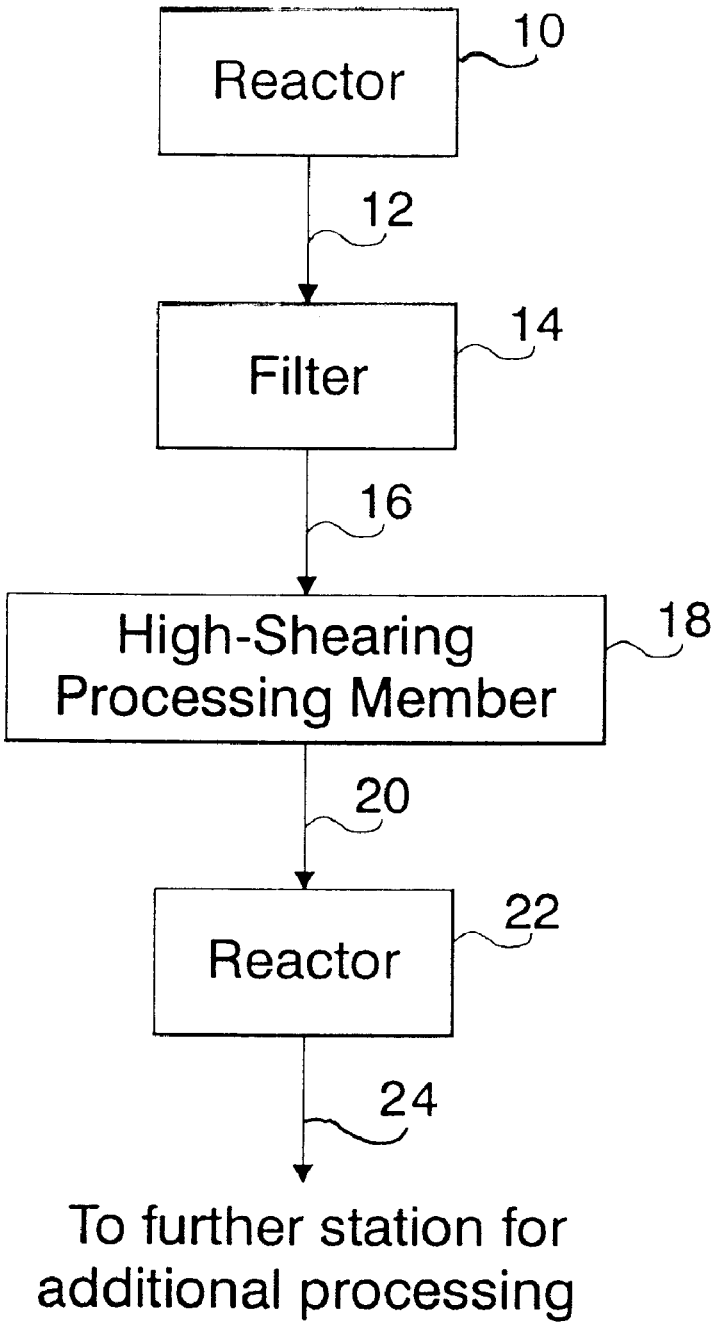
FIG. 1 is a block schematic diagram showing one exemplary process for producing a lubricating/sealing oil-based composition according to the present invention.

The present invention provides a lubricating/sealing composition which is intended for use in internal combustion engines and the like. According to one embodiment, the lubricating/sealing composition of the present invention comprises the following materials which are processed by a series of heating, pressure, and mixing steps: (1) a lubricating base oil, (2) modified microscopic polytetrafluoroethylene particles, (3) microscopic particles of metals (pure or as alloys), (4) microscopic particles of molybdenum disulfide, (5) chemicals as found in polytetrafluoroethylene internal combustion engine additive products, (6) unleaded gasoline with winter oxygenates, and (7) various combustion products (water/carbon monoxide etc.).

In a first embodiment which will hereinafter be referred to as Formulation 1, the lubricating/sealing composition of the present invention is processed by introducing the base lubricating oil into a test engine (Engine 1). The base lubricating oil may comprise a partially or fully synthetic oil or any other suitable oil intended for use in an internal combustion engine. For the purposes of Formulation 1, the base oil comprises a poly alpha olefin and polyol ester based lubricating oil which includes a multi-functional additive package. One such suitable base lubricating oil is commercially available from Exxon-Mobil Corporation under the trade name Mobil 1® 10 W 30. The microscopic particles of metals (pure or as alloys) are added to the composition and may be obtained through the worn and disintegrating parts of the test engine. Any number of metals are suitable for use in the composition of the present invention and several suitable metals include but are not limited to zinc, tin, copper, lead, antimony, aluminum, iron, platinum, and other precious metals. Particles of molybdenum disulfide are also introduced into the test engine. Molybdenum disulfide is often left behind as a residue when operational engine components and the like, e.g., cam shaft and follower, are replaced. Due to excess wear on the valve stems, cylinder rings, and cylinder walls, other elements including air, combustion products, and unleaded gasoline are also introduced into the composition of the present invention. It will be appreciated that it is within the scope of the present invention that the unleaded gasoline may be optionally omitted in the formulation of the present composition. The above-described elements are introduced into Engine 1 and processed during the normal operation of Engine 1 under ambient conditions.

In one exemplary embodiment, the base lubricating oil is present in an amount of at least about 90% by volume of the total composition and the polytetrafluoroethylene particles are present in an amount of at least about 0.01 % by weight of the total composition. In addition and according to one embodiment, the polytetrafluoroethylene particles and the metal particles are present in an amount so that a weight ratio of the polytetrafluoroethylene particles to the metal particles is within the range from about 1:1 to about 1:10 and a weight ratio of molybdenum disulfide to metal particles is within the range from about 1:1 to about 1:10. Furthermore, the volumetric ratio of the base lubricating oil to the unleaded gasoline is within the range from about 10:1 to about 100:1 based on the total volume of the composition. The volumetric ratio of the base lubricating oil to the water is within the range from about 10:1 to about 100:1 by volume of the total composition.

For the purpose of illustration, Engine 1 is initially filled with 8 quarts of the poly alpha olefin and polyol ester based lubricating oil and one quart of microscopic particles of polytetrafluoroethylene in mineral oil (containing chemicals found in polytetrafluoroethylene motor additive products, such as Slick 50®). According to the present invention, the plurality of polytetrafluoroethylene particles are modified by a process selected from the group consisting of electron beam bombardment, heating, and radiation, wherein in all the processes, the particles are modified in a fluid oxygen-containing environment, such as air. It is believed that during the modification a hydrated form of polytetrafluoroethylene results with the fluorine ions being replaced with hydroxyl ions. After 15 minutes of operation, three of the nine quarts of the present composition are removed from Engine 1 and set aside. After a predetermined number of miles, e.g., about 100 miles, of operation, the remaining six quarts of the composition are removed and also set aside. The lubricating/sealing composition of the present invention is then stored at a temperature of from about 40 to about 90° F. for a predetermined period of time. In one embodiment, the predetermined period of time is from about 3 to about 6 months. The resulting composition which is formed as a result of this process is Formulation 1 of the present invention.

Manufacture of the lubricating/sealing composition of the present invention may occur by any number of suitable manufacturing processes. For example, the lubricating/sealing composition may be produced using a series of industrial internal combustion engines which are engineered to efficiently produce the present composition. Such features are found with internal combustion engines used for ship propulsion and utility electrical power generation, etc.

Another embodiment of the present invention is presented in the lubricating/sealing composition set forth hereinafter as Formulation 2. The lubricating/sealing composition referred to as Formulation 2 has a similar chemical composition to that of Formulation 1, and was produced while attempting to replicate the production of Formulation 1 in the laboratory. The following process outlines a method for producing Formulation 2:

(1) Thread a 2 inch diameter, schedule 80, steel pipe. Apply three layers of polytetrafluoroethylene (PTFE) sealing tape (also known as TEFLON sealing tape) to the pipe and plug one end with a cap rated for 3000 psi. Tighten the cap to a torque which would allow it to withstand internal pressures of at least 1000 psi;

(2) Add the following to the pipe:
   (a) A thoroughly mixed emulsion of Mobil 1® 10 W 30 (80% by volume), and Slick® 50 (10% by volume), and water (10% by volume).
   (b) Eight (8) pieces of automotive connecting rod/main bearing material of approximately ½ inch×1 inch×⅛ inch in size.
   (c) Less than about 0.5 gram of aluminum powder (0.2 ml, dry volume) with a particle diameter of 10 microns;

(3) Thread a second cap, identical to the first, to the pipe along with three layers of the PTFE sealing tape. Tighten the cap to a torque that can withstand internal pressures of at least 1000 psi;

(4) Shake the pipe assembly for approximately for 1 minute to ensure thorough mixing and cool the assembly to a temperature of about 10° F. for at least 6 hours;

(5) Heat the pipe and its contents to approximately 330° F. for about 45 minutes. After allowing it to cool to room temperature, shake the pipe assembly vigorously for at one minute. Reheat the assembly to about 330° F. for about another 45 minutes. Cool the assembly to room temperature and shake the contents for about one minute;

(6) Cool the assembly to a temperature of about 10° F. for at least about 6 hours;

(7) Repeat step 5 and heat to an approximate temperature of about 450° F.;

(8) Remove the content from the pipe and filter through a 1/16 inch openings filter screen; and (9) The screened liquid can be optional aged to remove the odor.

Alternatively Formulation 2 can be produced according to the following procedure:

(1) In a pressure vessel rated for 1000 psi, introduce the 500 ml (mixed emulsion including metal particles, 8 pieces of bearing metal of approximately 1 cc with a surface area of 10 $cm^2$, and 1 gram of PTFE sealing tape;

(2) Place the vessel into an industrial shaker for about 1 minute of vigorous shaking;

(3) Cool the vessel and its contents to a temperature of 10° F. for 4 to 10 hours;

(4) Heat the vessel to approximately 310° F. for about 45 minutes;

(5) Remove the heat source and, and after cooling the vessel to room temperature, shake the vessel and its contents vigorously for about 1 minute;

(6) Reheat the vessel to 310° F. for about 1 to 3 hours;

(7) Remove the heat source and allow the vessel to cool down to ambient temperature. Using an industrial shaker, vigorously shake the vessel and its contents for approximately one minute;

(8) Repeat step 4;

(9) Repeat step 5, 6, and 7, this time heating the vessel to approximately 510° F.; and

(10) Removed the vessel from the shaker and filter the contents through a 1/16" screen.

It being understood that the above-described processes are merely exemplary in nature and do not serve to limit the present invention. The recited parameters may be altered so long as the resulting composition has the desired characteristics set forth herein.

The following examples further illustrate the invention and, are not intended to be limiting. It is evident to one skilled in the art, that the ingredients of various compositions, their relevant amounts, as well as other processing parameters, can be modified while being within the scope and the contemplation of this invention.

EXAMPLE 1

Illustrating the use of the Lubricating/Sealing Composition of Formulation #1

In this experiment, the test engine was a 1985, 2.2 liter, Dodge Charger engine which showed an oil consumption of one quart per 750 miles, and had 95,000 miles of wear. The oil was removed from the engine. The engine was then filled with the lubricating/sealing composition of Formulation 1. The lubricating oil used for the four subsequent additions (one quart per addition) was also the lubricant/sealant of Formulation 1. The oil consumption rate was measured and is set forth below.

(1) The initial oil consumption was 1 quart per 750 miles.

(2) After about 5,600 miles of operation, the sealing effect of the lubricating/sealing composition of the present invention became apparent and it reduced the oil consumption to 1 quart per 2,445 miles which compares favorably to the oil consumption of a new car with very little engine wear.

(3) Beyond 5,600 miles of operation, the oil consumption averaged one quart per 2,018 miles, and this average was held constant for the next 10,089 miles. This indicates a three-fold decrease in the oil consumption as a result of the lubricating/sealing composition of the present invention being added to the engine.

EXAMPLE 2

Illustrating the use of the Lubricating/Sealing Composition of Formulation #2.

The test engine of Example 1 overheated due to a leaking radiator which resulted in a leaking head gasket. Approximately 800 ml. of the lubricating/sealing composition of Formulation 2 was added to the engine. The engine's oil consumption decreased from one quart per 800 miles, to one quart per 1,476 miles and the head gasket leak was automatically sealed as a result of the addition and use of the present composition. There were several subsequent overheating episodes and the oil consumption increased concurrent to these overheating episodes. Along with each overheating episode there were very strong indications of head gasket leakage. Second and third additions of Formulation 2 were made. The addition was one quart each time. Table 1 illustrates the data recorded in this experiment.

TABLE 1

Performance Evaluation and Comparative data for Formulation 2.

| Odometer Reading | Apparent Oil Consumption Miles/Quart | Comments |
|---|---|---|
| 0 | | Oil and Filter Change |
| 1,978 | (1,563) | Prorate, started in overfill condition. |
| 2,866 | 888 | |

TABLE 1-continued

Performance Evaluation and Comparative data for Formulation 2.

| Odometer Reading | Apparent Oil Consumption Miles/Quart | Comments |
|---|---|---|
| 3,101 | | Overheating; Leaking Gasket |
| 3,810 | 944 | |
| 4,573 | 763 | |
| 5,800 | (1,476) | prorate; plus 30% of driving at 80 MPH |
| 6,500 | | Overheating |
| 6,735 | 935 | Changed Filter |

The results presented in Table 1, lead to the following conclusions:

1) Formulation 2 decreased oil consumption by 55%.

2) Formulation 2 achieved a sealing of the combustion chamber which included a leaking head gasket etc. on at least two occasions.

The lubricating/sealing composition of the inventions sustained functionality in approximately 7,000 miles (140 hours) of operation in a combined cycle mode (internal combustion engine—steam engine). This performance is beyond that of other lubricants currently marketed. Such combined cycling has been in use for more than 50 years for short time frame power boost applications. The most widespread being on military aircraft internal combustion engines for war emergency power boost with water injected into the combustion chamber. This gave 30% boost in power with a limit of five minutes before engine failure. The combined cycling (internal combustion engine - water to steam in the combustion chamber engine) which this lubricant allows on a steady state normal operation mode yields increased fuel efficiency. The increase in efficiency with the water into the combustion chamber is associated with a 10 percent increase in fuel efficiency.

EXAMPLE 3

A lubricating oil consumption test was done using a one cylinder gasoline (220-cc displacement/7.8 hp) overhead valve industrial engine with a pressurized lubrication system including an oil filter. The engine was part of a 4000 watt AC generator (Generac 4000 XL, Model #OG777-2). The unit was connected to four 500 watt halogen lights. The unit operated at 50% of load. Both the generator and the halogen lights were new from the factory.

Test Procedure (1) Break in the generator with a lubricating oil (Oil A) for about four hours. In one embodiment, Oil A comprises an oil commercially available from Exxon-Mobile Corporation under the trade name EXXON "Super Flow" API SJ 10W30. The oil consumption is measured by draining the oil from the engine;

(2) Flush by filling the generator with Oil A and running for generator about one hour. The oil consumption is then measured by draining the oil;

(3) Fill generator with Oil A and run for about 20 hours with a new oil filter;

4) Measure oil consumption with improved precision by draining the oil and measuring the filter weight before and after;

5) Fill the generator with the lubricating/sealing composition of the invention (Oil B) and run for 20 about hours with a new oil filter; and 6) Measure oil consumption with improved precision by draining the present composition and measuring the filter weight before and after.

Results

Ten percent reduction in oil consumption when the lubricating/sealing composition of the present invention is used.

Preferably an emulsifying agent is added to the present composition for producing an emulsion. The addition of the emulsifying agent is done with the initial starting base materials, namely the base lubricating oil, the water, and the modified PTFE particles before application of heat, pressure, agitation, and shear to the composition. The emulsifying agent permits greater intimate contact between the ingredients which permits chemical reaction(s) between one or more of the ingredients to proceed. Any conventional emulsifier which is suitable for use in the present invention may be used in the present composition.

It is also within the scope of the present invention that other conventional components may be added to the present composition. For example, suitable components include but are not limited to dispersants, such as ashless nitrogen containing dispersants; ashless nitrogen containing dispersant-viscosity modifiers; antiwear and antioxidant agents; supplemental dispersants; supplemental friction modifiers; rust inhibitors; anti-foaming agents; pour point depressants and the like.

Now referring to FIG. 1 in which one exemplary process for producing the present lubricating/sealing composition is provided. An agitated reactor 10 is provided for receiving several of the individual initial base ingredients of the present composition. The agitated reactor may comprise any number of suitable reactors and preferably, the reactor 10 includes temperature controlling elements, such as jacketing, heating coils, etc. The reactor 10 further includes means for adding ingredients so that the amount of the ingredients in the composition may be monitored. When the composition comprises Formulation 1, the function of the reactor 10 is comparable to a typical crankcase and when the composition comprises Formulation 2, the function of the reactor 10 is comparable to a lower temperature agitation process. According to one embodiment, the base lubricating oil, polytetrafluoroethylene particles, metal particles, emulsifying agent and water are present in the reactor 10 and it will be appreciated that the reactor 10 may also include an amount of molybdenum disulfide and gasoline. A line 12 fluidly connects the reactor 10 to a filter 14. The filter 14 comprises any suitable filtering medium and serves to separate large particles from the mixture obtained from reactor 10. A hydrocloning process or the like or any other suitable separation process may be used to accomplish the desired separation. This step is thus similar to the workings of an automotive oil filter which serves to filter any particles over a given size from the oil lubricant.

After the lubricant/sealing composition has been filtered, the composition flows through line 16 to a high shear processing member 18. One exemplary member 18 comprises a heat exchanger and homogenizer and alternatively, the member 18 may comprise a roller mill or the like. When the composition comprises Formulation b 1,the function of the high shear processing member 18 is comparable to a poorly fitted bearing, etc. and when the composition comprises Formulation 2, the member 18 serves to agitate the composition with the metal pieces. A line 20 connects the high shear processing member 18 to a high temperature and pressure reactor 22. Reactor 22 may be in the form of a conventional turbine agitated reactor, inline agitator with a pump and a heat exchanger, etc. For Formulation 1, this action is in the form of lubricating oil in the area of the rings in contact with the combustion occurring in an operating engine. For Formulation 2, this action is in the form of agitation of the composition at a temperature from about 400°–500° F. The composition then flows through a line 24 from the reactor 22 which transfers the composition to a further processing station (not shown), such as a packaging and/or storage station.

FIG. 1 generally illustrates the processing sequence according to one embodiment and the above-description serves to set forth exemplary equipment that may be used at each of the processing steps. It will be appreciated that the above discussion is merely exemplary in nature and does not serve to limit the present invention. FIG. 1 is intended to illustrate one possible processing configuration for a large scale production of the composition of the present invention.

Accordingly, the present invention presents a lubricating/sealing composition which is particularly adapted for use in internal combustion engines and the like. In addition, one particular setting for use of the present composition is in air breathing turbine (jet engine) lubricating oil applications. Because of the unique properties of the present composition, a less viscous oil may be used while at the same time, the efficiency of the engine is improved. The present composition not only provides the necessary lubricating properties but also provides sealing properties such that the addition of the present composition into the engines, for use as the main lubricating medium, acts to seal locations in the engine which are prone to leaks. Over time, extended engine use causes wear of the engine components and this can form slight separation of engine components and deterioration of components such that gaps are formed which permit the lubricating oil to fluidly seep from the engine. Thus, it is very common for older vehicles and the like to consume an amount of oil between oil changes due to leaks. The present invention permits such vehicles to operate more cost effective by reducing the oil consumption resulting in improved engine performance and decreased emissions.

Yet another advantage of the present invention is that the present composition permits use of lower viscosity oils in environments where heavier oils (greater viscosities) were previously used. For example, in engines which suffer from increased oil consumption and/or other operating inefficiencies, it is typically recommended that heavier (more viscous) oils be used to combat these problems and in an attempt to improve the operating efficiency of the engine. The present composition which generally has lower viscosity characteristics compared with heavier oils (e.g. 20W50) advantageously permits the use of a lower viscosity oil in a setting in which heavier oils were previously recommended for use. This results in greater latitude of use while not jeopardizing the improved operating conditions which results from the use of the present composition. In addition, the present composition finds particular utility in European markets which typically utilize lower viscosity oil lubricants (partially or fully synthetic) for use in internal combustion engines and the like.

While the invention as been particularly shown and described with reference to the preferred embodiments thereof, it will be understood by those skilled in the art that various changes in form and detail may be made therein without departing from the spirit and scope of the present invention.

What is claimed is:

1. A lubricating/sealing oil-based composition for use as a lubricating medium, the composition comprising:

a base lubricating oil;

a plurality of polytetrafluoroethylene particles;

an emulsifying agent;

a plurality of insoluble metal particles; and water, wherein the composition is subjected to an elevated temperature, elevated pressure, agitation and elevated shear in the manufacture thereof.

2. The composition of claim 1, further comprising: gasoline.

3. The composition of claim 1, further comprising:

a plurality of molybdenum disulfide particles.

4. The composition of claim 1, wherein the base lubricating oil is selected from the group consisting of poly alpha olefin compositions, polyol ester compositions, mineral oils, and combinations thereof.

5. The composition of claim 1, wherein the plurality of metal particles is selected from the group consisting of zinc, tin, antimony, copper, lead, aluminum, iron, platinum, and combinations thereof.

6. The composition of claim 1, wherein the plurality of metal particles comprises a plurality of aluminum particles having an average particle size of less than about 10 micron.

7. The composition of claim 1, wherein the polytetrafluoroethylene particles are modified by a process selected from the group consisting of electron beam bombardment in a first environment, heating in a second environment, and radiation in a third environment.

8. The composition of claim 7, wherein the first, second and third environments comprise fluid oxygen-containing environments.

9. The composition of claim 1, wherein the base lubricating oil is present in an amount of at least about 90% by volume of the total composition.

10. The composition of claim 1, wherein the plurality of polytetrafluoroethylene particles is present in an amount of at least about 0.01% by weight of the total composition, the polytetrafluoroethylene being a modified form as a result of being subjected to electron beam bombardment.

11. The composition of claim 1, wherein a weight ratio of the plurality of polytetrafluoroethylene particles to the plurality of metal particles is from about 1:1 to about 1:10.

12. The composition of claim 3, wherein a weight ratio of the plurality of molybdenum disulfide to the plurality of metal particles is from about 1:1 to about 1:10.

13. The composition of claim 1, wherein a volumetric ratio of the base lubricating oil to the water is from about 10:1 to about 100:1.

14. A lubricating/sealing oil-based composition for use as a lubricating medium, the composition comprising:

a base lubricating oil;

a plurality of polytetrafluoroethylene particles in a hydrated form with the fluorine ions (F) being replaced by hydroxyl ions (OH);

an emulsifying agent;

a plurality of insoluble metal particles; and water, wherein the composition is subjected to an elevated temperature, elevated pressure, agitation and elevated shear in the manufacture thereof so as to yield the hydrated form of polytetrafluoroethylene.

15. A process for forming a lubricating/sealing oil-based composition for use as a lubricating medium, the process comprising the steps of:

(a) mixing in a closed container a base lubricating oil, an emulsifying agent, a plurality of polytetrafluoroethylene particles, a plurality of insoluble metal particles, a plurality of molybdenum disulfide particles and water to form a mixture;

(b) heating the mixture in the closed container to a first elevated temperature, the mixture being agitated in the closed container;

(c) cooling the mixture;

(d) reheating the mixture with agitation to a second elevated temperature;

(e) cooling the mixture; and (f) aging the mixture at an aging temperature for a period of time.

16. The process of claim 15, wherein the first elevated temperature is about 330° F.

17. The process of claim 15, wherein the second elevated temperature is about 450° F.

18. The process of claim 15, wherein the mixture is cooled to a temperature of about 10° F.

19. The process of claim 15, wherein the aging temperature is between about 40° F. and about 90° F.

20. The process of claim 15, wherein the period of time is between about 3 months to about 6 months.

21. The process of claim 15, wherein said lubricating base oil is selected from the group consisting of poly alpha olefin compositions, polyol ester compositions, mineral oils, and combinations thereof.

22. The process of claim 15, wherein the mixing process is performed by a homogenizer exhibiting high shear.

23. The process of claim 15, wherein the composition is pressurized to a pressure of from about 500 to about 1000 psi during the mixing process.

24. The process of claim 15, wherein the plurality of metal particles has an average particle size of from about 0.1 to about 10 micron.

25. The process of claim 15, wherein the mixing and heating of the composition yields a hydrated form of polytetrafluoroethylene with the fluorine ions (F) replaced by hydroxyl ions (OH).

26. The process of claim 15, wherein the polytetrafluoroethylene particles are modified by a process selected from the group consisting of electron beam bombardment in a first environment, heating in a second environment, and radiation in a third environment, the first, second and third environments being fluid oxygen-containing environments.

27. The process of claim 15, wherein the plurality of metal particles are added in the form of a plurality of aluminum particles having an average particle size less than about 10 micron.

28. The composition of claim 14, wherein in the hydrated form, at least some of the fluorine ions (F) of the polytetrafluoroethylene particles are substituted with hydroxyl ions (OH).

* * * * *